United States Patent [19]

Buhrer

[11] 3,974,872

[45] Aug. 17, 1976

[54] METHOD AND APPARATUS FOR PRODUCTION OF CASTING MOLDS

[76] Inventor: Erwin Buhrer, Vogelingasschen 40, Schaffhausen, Switzerland

[22] Filed: Dec. 17, 1973

[21] Appl. No.: 425,493

[30] Foreign Application Priority Data

| | | |
|---|---|---|
| Oct. 9, 1973 | Switzerland | 14384/73 |
| Dec. 27, 1972 | Switzerland | 18873/72 |

[52] U.S. Cl. ..... 164/40; 164/37; 164/187; 164/222; 249/126

[51] Int. Cl.[2] ..... B22C 15/22

[58] Field of Search ..... 425/246, 441, 242, 129, 425/130, 242 B; 164/18, 23, 24, 37, 40, 181, 187, 222, 180, 129, 322, 323; 249/126

[56] References Cited

UNITED STATES PATENTS

| | | | |
|---|---|---|---|
| 1,666,578 | 4/1928 | McCabe | 164/187 |
| 3,129,462 | 4/1964 | Borah | 425/351 |
| 3,672,434 | 6/1972 | Grolla | 164/187 |
| 3,695,339 | 10/1972 | Taccone | 164/37 |
| 3,702,750 | 11/1972 | Veneria | 425/130 |
| 3,804,576 | 4/1974 | Hehl | 425/130 |
| 3,817,314 | 6/1974 | Deve | 164/187 |
| 3,838,731 | 10/1974 | Abraham et al. | 164/181 |

FOREIGN PATENTS OR APPLICATIONS

| | | | |
|---|---|---|---|
| 626,053 | 8/1961 | Canada | 164/201 |
| 2,004,699 | 3/1970 | Germany | 164/18 |

*Primary Examiner*—Francis S. Husar
*Assistant Examiner*—Carl Rowold
*Attorney, Agent, or Firm*—Toren, McGeady and Stanger

[57] ABSTRACT

In a system for the production of molds for casting, a pair of pattern plates are disposed in an opposed facing relationship with a frame located therebetween in a manner whereby the opposing pattern surfaces of the plates, together with the frame, define an enclosed cavity within which a casting mold section may be formed. The frame is preferably provided with an opening through which the cavity may be filled with molding material which, after hardening, forms a mold section. After separation of the pattern plates and frame, the mold section is conveyed into assembled relationship with one or more other mold sections in order to form a mold for casting. Pattern plates and frames may be arranged in a mass production facility to continuously form mold sections which, when assembled, will provide a mold stack for producing multiple castings.

22 Claims, 24 Drawing Figures

Fig. 6
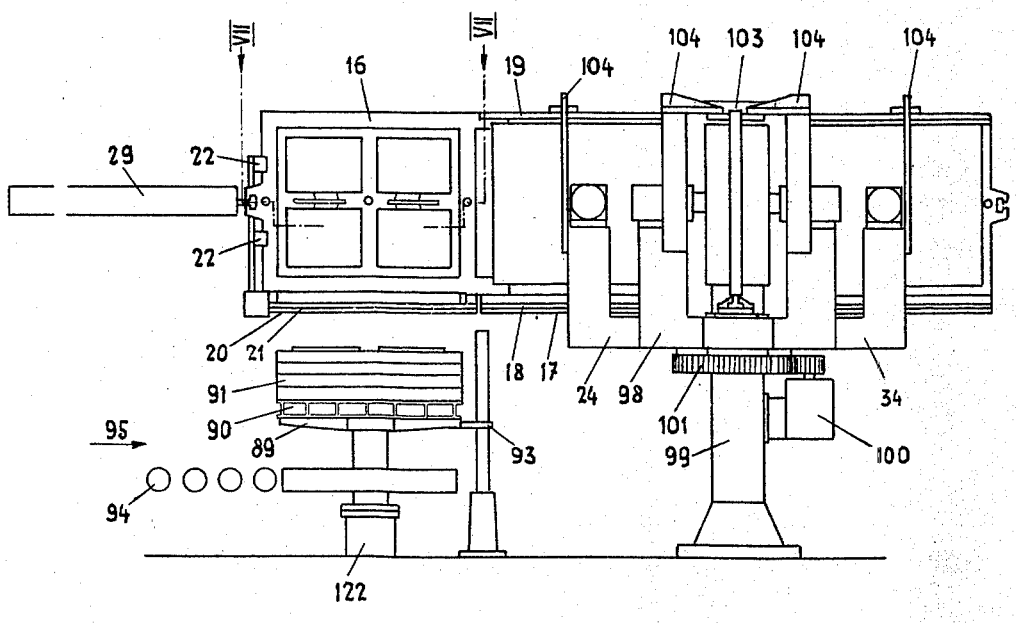
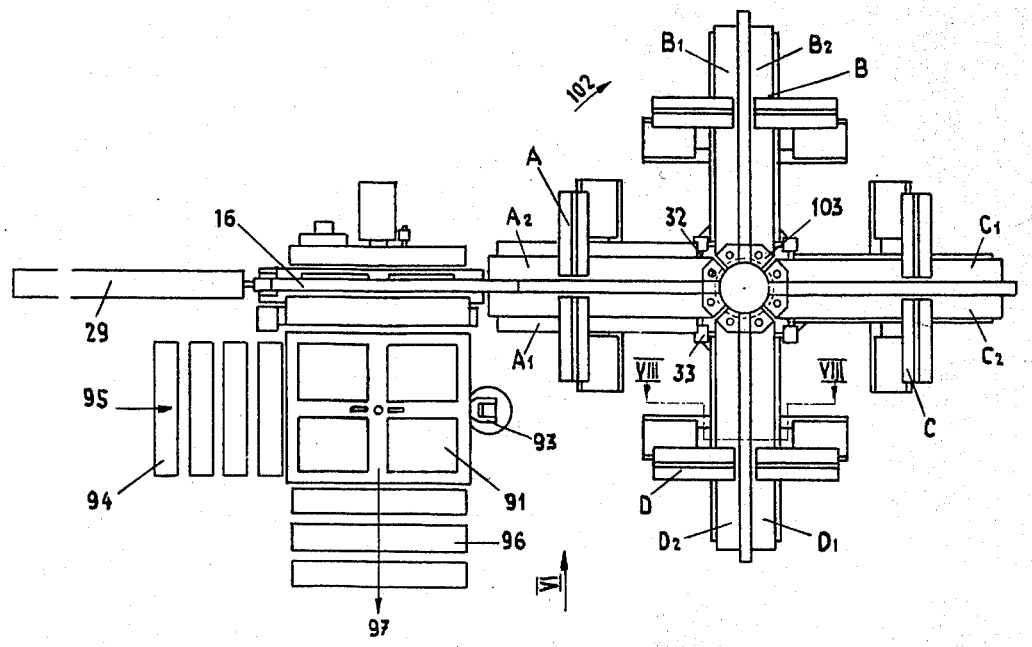
Fig. 5.

METHOD AND APPARATUS FOR PRODUCTION OF CASTING MOLDS

BACKGROUND OF THE INVENTION

The present invention relates generally to the production of casting molds, and more particularly to a system whereby at least two pattern plates are arranged with their partern surfaces in opposing relationship to define a cavity within which a mold section is formed. It has been heretofore known to fill a molding cavity defined between the two opposing walls of a pair of pattern plates with clay-bonded molding sand precompressed by means of compressed air, and subsequent to the filling operation to compress the molding sand to form a mold. After one of the pattern plates has been retracted and swung out of position, the mold thus produced is ejected from the molding cavity by the other pattern plate and it is pushed onto a mold row and pressed upon. It is possible to insert into the mold thus formed cores which either bear on the mold base or which are suspended in the mold. After the ejecting pattern plate is retracted and the pattern plate which has been swung out of position is returned to its original location, a new mold is produced in the above described cycle and at the same time the mold is cast on end at a sufficient distance from the molding machine. After the iron in the cast molds has cooled off sufficiently, the latter are dropped at the end of the mold zone onto an emptying grid.

A disadvantage of this method is that the mold surface thus produced can only be covered to a minor extent with patterns, because of the ferrostatic pressure and because of the necessity for casting the molds on end. Another disadvantage resides in the fact that, in molds cast on end, an additional part of the mold surface can not be used for the extended casting system. Another disadvantage is that the cooling time of the molds between casting and emptying is limited by the maximum permissible length of the mold stack. Still another disadvantage, which limits the use to mass castings, results from the fact that expensive pattern plates are necessary for carrying out this method. The greatest disadvantage, however, arises in the production of castings whose material analysis depends on wall thickness, such as grey cast iron, spheroidal cast iron and the like. For each of the plants utilizing these techniques, liquid metal must be available at any time for the material-analysis, because the molds thus produced are not storable. This direct interdependence between a molding plant of relatively low capacity and the smeltery leads therefore in practice to the requirement for a plurality of smaller smelting units.

Furthermore, there is presently known a plant (British Patent No. 1,066,833) which produces in one operation from plastic-bonded sand a lower mold section, an upper mold section and the respective cores, and which subsequently joins these sections mechanically in a ready-to-cast mold. This production method has the disadvantage that it requires relatively large quantities of plastic-bonded molding sand, which is expensive. Furthermore, like the first described method, the molds can only be cast on end, thereby resulting in a lower metallic yield and high ferrostatic pressure. In addition to the above described disadvantages, these plants have an extremely low output.

The development of recent foundry techniques has generally been in the direction of producing molding and casting plants having a higher mold face output per hour. Furthermore, the tendency is to increase the utilization of the mold faces beyond presently known values by covering the pattern plates as extensively as possible with the molding pattern. Such molding and casting plants achieve their optimum production capacities only if the working range of these plants, as far as length, width and height of the models is concerned, can be extended beyond presently known dimensions. If such molding and casting plants are used for the production of general jobbing items, it will be found that a residual order of small castings of suitable quality can no longer be economically produced in these plants. Such small castings must generally be produced in orders of relatively large quantity. Also, such small castings must have narrower mass tolerances and better finishes than can be produced in high-capacity molding and casting plants which utilize plastic-bonded sand. Furthermore, it will be found that thin-walled castings cannot be produced economically on heavy duty machines together with large castings, because of the risk that the casting will break during separation from the mold or during cleaning operations.

Additionally, as is commonly known, a jobbing foundry must maintain in stock a great number of pattern plates which are seldom used but which are required for the production of spare parts or other small orders. In many instances, such orders cannot be accepted by a high-capacity plant because of the time required for changing the pattern plates which, in a high-capacity molding or casting plant, is much too expensive.

The production of flat, low castings of relatively great length and width, such as for example, side shields for textile machines and similar equipment, requires special molding machines. These are mostly high-pressure squeezers which work with low molding boxes, reinforced with closely arranged traverses. These special machines are necessary because of the accuracy required of the castings, but their capacity is poorly utilized due to the limited number of orders usually received.

Thus, it is an object of the present invention to alleviate the above-mentioned drawbacks in the production methods available to a modern foundry.

SUMMARY OF THE INVENTION

The solutions in accordance with the method and apparatus of the present invention are attained in a system utilizing pattern plates spaced apart by a frame arranged between them, with the plates and the frame being secured in position to define a cavity and enclosing the patterns and the casting system. The cavity thus formed by the pattern plates and the frame is filled with molding material through at least one opening provided in the frame. The material is permitted to harden in a known manner to form a mold section, after which two mold sections thus produced are combined to form a mold within which a casting is formed.

By a further aspect of the invention, it is possible to use pattern plates which are covered on one or on both sides with patterns. Preferably the mold sections which are combined to form a mold stack are cast horizontally or slightly inclined to the horizontal. Partial pattern plates which have a common casting system and which are held in a common pattern frame can also be used. The stacking method can be particularly utilized for casting large flat molds in a manner whereby at least one molding box frame is placed around the mold stack, with the spacing between the mold stack and the molding box frame being filled before casting with a filling material, e.g., pure quartz sand without a binder.

The method according to the invention is carried out by means of an arrangement utilizing two pattern plates having patterns extending over the surfaces thereof. Guide elements are provided on the pattern plates between which can be placed a frame having parallel end faces, wherein the inside dimension of the frame is so selected that the frame encloses the patterns with the casting system while maintaining a fixed distance therebetween, as is customary with molding boxes. The frame thickness spaces the pattern plates from each other a predetermined distance, and includes guide surfaces which form counter-surfaces for the guide elements of the pattern plates. The frame is formed with openings through which the cavity formed by the frame and the pattern plates can be filled with molding material. Means are provided to hold the pattern plates together with the interposed frame and to separate them from each other.

In horizontal casting, the journals of the pattern plates forming the gate of the mold contact each other when the pattern plates are applied to the interposed frame.

Furthermore, the mold can be released after its production in a manner whereby the frame is divided into two parts. Alternatively, a device is provided which ejects the mold from the frame. The joining of the mold parts without a stopper is made possible by providing stop faces or guide sleeves.

The pattern plates are preferably clamped with the interposed frame by means of clamps. As a result, it is possible to dimension the means for holding and separating the pattern plates with the interposed frame only with regard to the separating process. The clamps also have the effect that a larger size mold can be selected.

The clamps can retain the frame during the separation of the pattern plates with regard to the devices for separating the pattern plates, so that tilting of the frame relative to the pattern plates during the separation is avoided.

Furthermore, guides are provided on the frame whose width does not exceed the smallest dimension of the thickness of the interposed frame and which is flush on one side of the guide with the frame. When, for example, a carousel arrangement is to be utilized, model devices which require frames of different thickness can be operated at the same time on the same carousel.

Furthermore, the device which applies the pattern plate on the frame or which separates it from the plate can have stroke limitations on the side on which the frame is flush with the guide, so that a change of position of the guide in its operating position is prevented when frames of different thickness are used at the same time.

In order to facilitate change of the pattern plates and to reduce the time required for such change, a pattern plate carrier or the pattern plate itself can be pivoted on a bearing.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE DRAWINGS

In The Drawings

FIG. 5 is a plan view of an embodiment of a molding system according to the invention;

FIG. 6 is a side elevation taken in the direction of the arrow VI in FIG. 5;

DETAILED DESCRIPTION OF THE PREFERRED EMBODIMENTS

Figure 12:
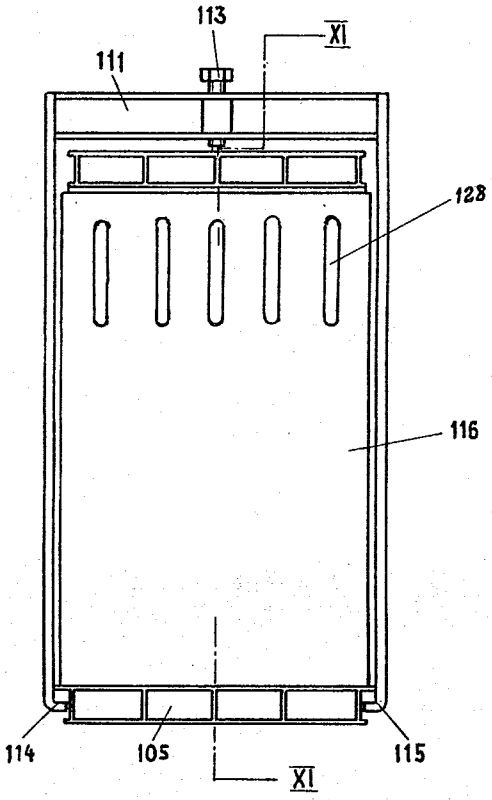
FIG. 12 is a side elevation taken in the direction of the arrow XII in FIG. 11.
Figure 14:
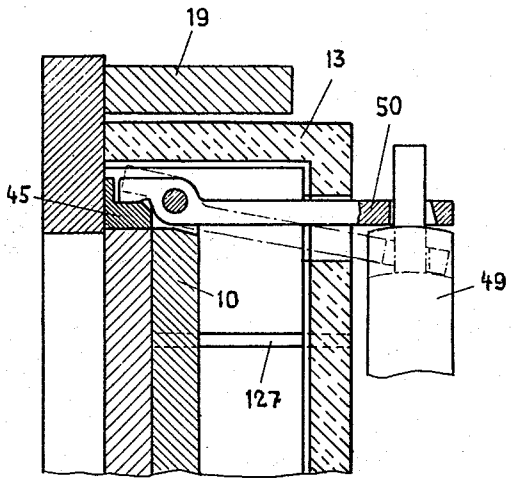
FIG. 14 is a section taken along the line XIV—XIV in FIG. 13.
Figure 13:
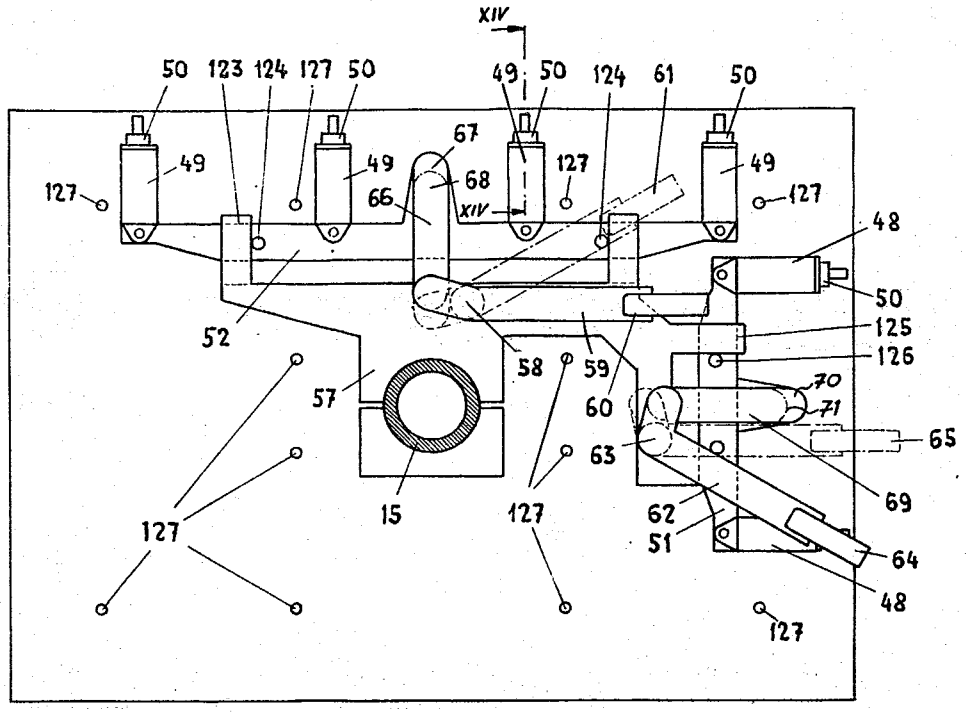
FIG. 13 is a section taken along the line XIII — XIII in FIG. 7.

In FIGS. 1 to 12, a lower pattern plate 1 and an upper pattern plate 2 are shown, which consist of partial pattern plates, 3, 4 and 5, 6 with an interposed ruler 7 and 8, respectively. Permanent magnets 9 which hold the partial pattern plates 3, 4, 5, 6 as well as the rulers 7, 8 are inserted in base plates 10, 11. Rulers 40, 41 are held by permanent magnets 42, 43 on the base plates 10, 11, and additional rulers 44, 45 which are held by magnets 46, 47 are likewise included on the base plates 10, 11. The rulers 40, 41, 44 and 45 are pressed on the partial pattern plates 3, 4, 5, 6 and on the rulers 7, 8 respectively as represented in FIGS. 13 and 14, by pressing means 51, 52 over spring bushes 48, 49 and levers 50, which are mounted in the base plates 10, 11. This has the effect that all the partial pattern plates and rulers inserted in the base plates are pressed on stop faces 53, 54 and 55, 56 respectively of the base plates 10, 11 by an action similar to that of a printer's angle. A carrier 57 (FIG. 13), which is secured on a piston rod 15, carries over a pivot 58 a lever 59 which can be turned from a position 60 in which it can be locked into a position 61 indicated by broken lines. The carrier 57 also carries a lever 62 which is mounted in a fulcrum 63 and which can be turned from a lockable position 64 into position 65 indicated by broken lines. By turning the lever 59 from the position 60 into position 61, a connecting piece 66 is moved from position 67, in which the pressing means 52 presses the levers 50 over the spring bushes 49 into position 68. In position 68, the spring bushes 49 are retracted and the levers 50 are thus relieved. The partial pattern plates 3, 4 and 5, 6 inserted respectively into the base plates 10, 11 and thus relieved in a vertical direction. When the lever 62 is moved from position 64 into position 65, the connecting piece 69 and the pressing means 51 move out of position 70 into position 71. In position 71, the spring bushes 48 are retracted and their levers 50 are thus relieved. The partial pattern plates 3, 4 and 5, 6 inserted in the base plates 10, 11 and the rulers, 7, 8 are thus relieved in a horizontal direction.

Figure 7:
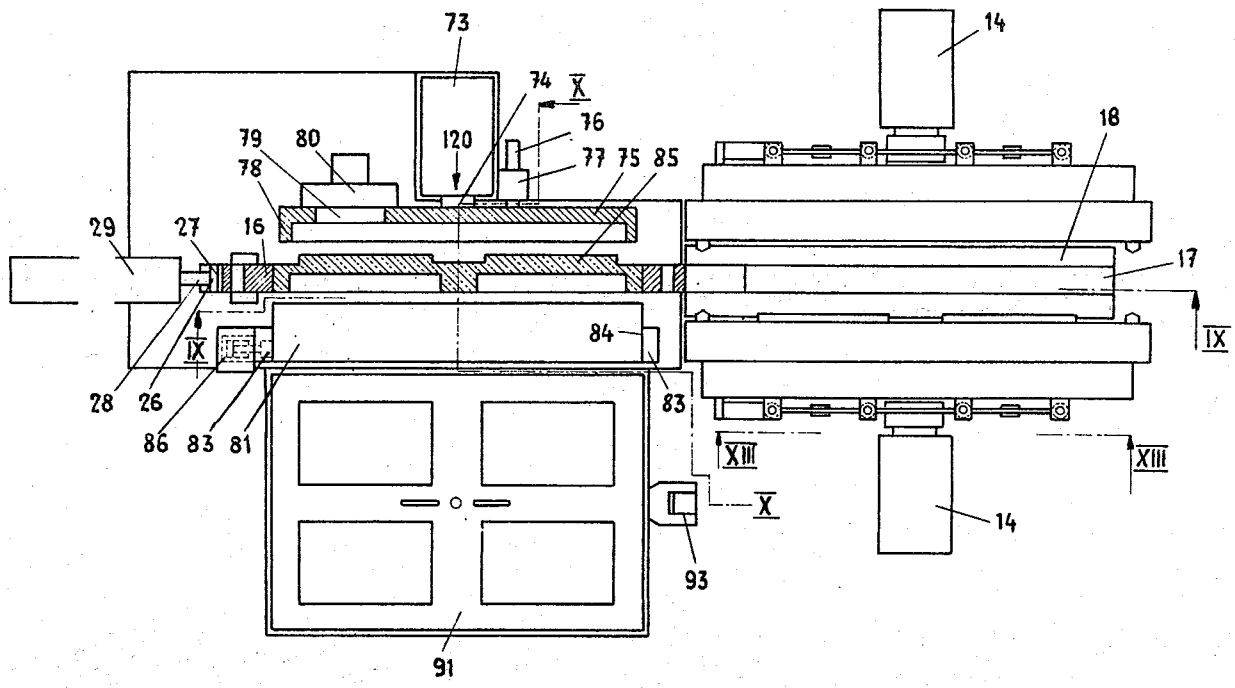
FIG. 7 is a partial section of the system of FIG. 6 taken on an enlarged scale along the line VII—VII of FIG. 6 (without pressing means)

When changing the partial pattern plates 3, 4, 5, 6, the lever 59 is first brought from position 60 into position 61 and lever 62 from position 64 into position 65. The pressing means 52, which is held in guides 123 and by bolts 124, is thus retracted by the path from position 67 to position 68 and the pressing means 51, which is held in the guides 125 and by the bolts 126, is retracted by the path from position 70 to position 71. The prestressed spring bushes 49, 48 are thus likewise retracted and operate to release the levers 50 as well as the rulers 40, 43 and 41, 44 which are nevertheless still held, by the magnets 42 and 47. Openings 127 (FIGS. 13 and 14) in heat insulation 13 and in the base plates 10, 11 permit the partial pattern plates 3, 4, 5, 6 to be pressed away from the magnets 9 into the open position as shown in FIG. 7 by means of a suitable tool, thus allowing them to be removed from the base plates 10, 11 and from production. After the preheated partial pattern plates 3, 4, 5, 6 to be subsequently used are inserted into the base plates 10, 11, the levers 59, 62 are again brought into their positions 60, 64 and the rulers 40, 43 and 41, 44 together with the partial model plates 3, 4, 5, 6 are pressed against their cooperating surfaces in the base plates 10, 11.

The insulation 13 is provided with electrical heating coils 12. A lifting cylinder 14 whose piston rod 15 is designed partly as a tube to reduce the heat losses is also provided.

Figure 9:
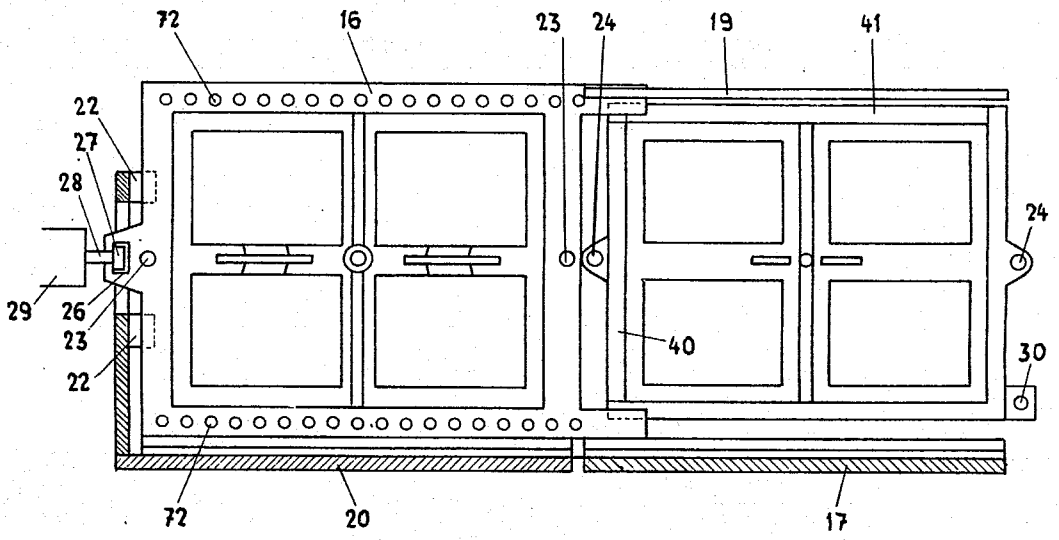
FIG. 9 is a section taken along the line IX—IX of FIG. 7.
Figure 8:
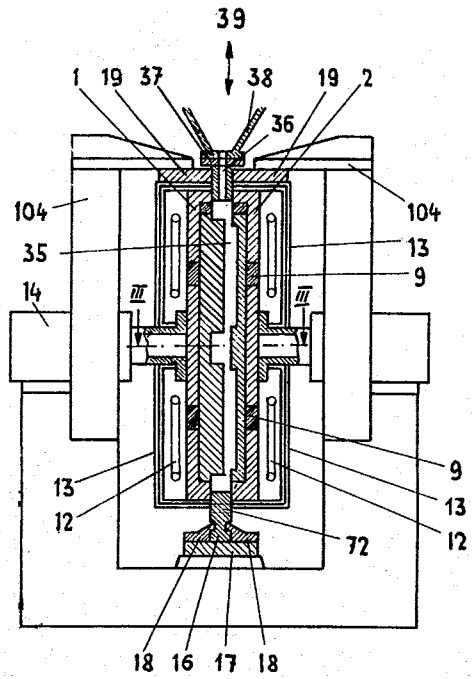
FIG. 8 is a side elevation taken in the direction of the arrow VIII in FIG. 5 with a partial section taken along the line VIII—VIII.
Figure 10:
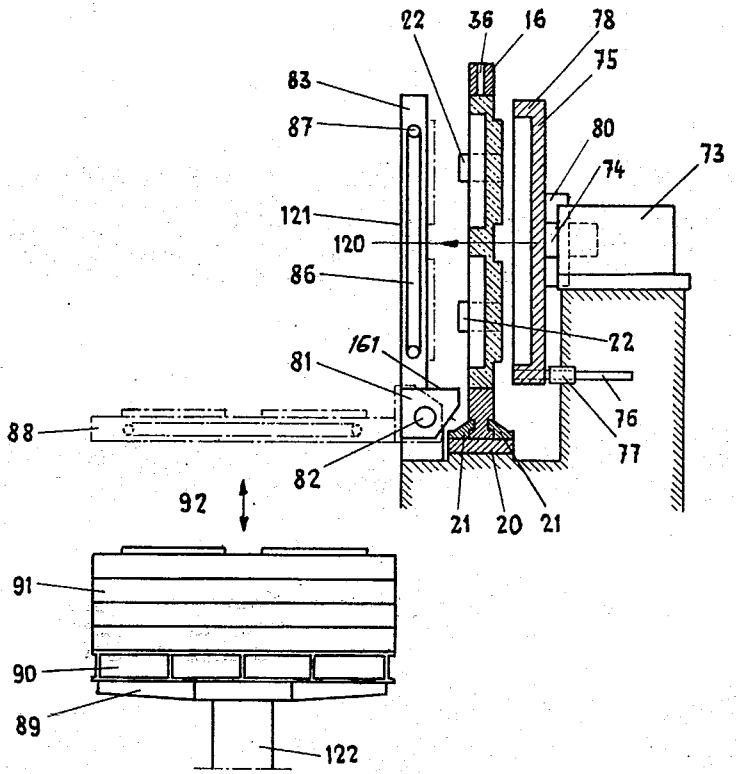
FIG. 10 is a section taken along the line X—X in FIG. 7.

In a support 17, 20 and in guides 18, 19 and 21, 22, there is mounted a frame 16 adaptable to effect horizontal displacement (FIGS. 8, 9, 10). The frame 16 has bores 72 to reduce the heat losses caused during operation. In frame 16 there are also provided bores 23 into which there can be inserted both dowels 24 of the upper pattern plate 2 and dowels 25 of the lower pattern plate 1. Frame 16 includes a T-groove 26 into which a piston rod head 27 of a piston rod 28 of a cylinder 29 can be retracted or extended. The base plate 10 has a bore 30 and the base plate 11 a bore 31 which are engaged by guide dowels 32, 33 (FIG. 5) which are rigidly connected with a rotatable base frame 34 (FIG. 6) and which secure the lower pattern plate 1 and the upper pattern plate 2 against rotation, even if they are moved horizontally by the cylinders 14.

Frame 16, lower pattern plate 1 and upper pattern plate 2 define a cavity 35 (FIG. 8) when the pattern plates are assembled on frame 16, which cavity is in communication with the blow head 38 through bores 36 in the frame 16 and in the blow plate 37. The blow plate 37 can be raised and lowered with the blow head 38 in the direction of the arrow 39.

In FIGS. 7 and 10, a cylinder 73 having a piston rod 74 carries a plate 75. The plate 75 is provided with an edge 78 and with a guide pin 76 in a guide 77 which secures the plate 75 against rotation. Above an opening 79 of plate 75 there is arranged a fan 80. A support 81 mounted rotatably in an axle 82 carries a U-frame 83 whose stop face 84 serves as a stop for an ejected mold section 85, which can be made to bear on the stop face 84 by a pressing means 86. A swivel drive (not shown) turns the U-frame 83 from the vertical position 87 into the horizontal position 88. A table 89 having arranged thereon a bed plate 90 supports thereupon finished mold sections 91. The table 89, which can be raised and lowered in the direction of the arrow 92, is secured against rotation by means of a guide 93. A conveyor 94 (FIG. 6) feeds in the direction of the arrow 95 bed plates 90 to the table 89 which is lowered into its bottom-most position (FIG. 5). A conveyor 96 operates to remove mold sections 91 stacked on the bed plate 90 in the direction of the arrow 97 from the lowered table 89.

In FIGS. 5 and 6, A, B, C and D denote four molding units which are arranged on a common frame 98 rotatably mounted on a vertical rotating column 99. The number of molding units on the frame 98 can be varied, depending upon the production time of the mold sections 85. The molding units A, B, C, D, whose structure and configuration were described in connection with FIGS. 1–4, 8, 13 and 14, can be rotated in steps through angles of 90° in the direction of rotation 102 each by a drive 100 operating through gearing 101.

In order to increase the accuracy of the respective stationary positions, the motor of the drive 100 is designed in known manner with a reversible polarity. A common frame 97 carries at its center of rotation a support 103 on which the guides 19 of the molding units A, B, C, D bear. An additional support for the guides 19 is formed by the carriers 104.

The feed of electric power for heating, the feed lines for the pressure media for actuating the various cylinders, and the connections between the control elements and the molding units which are arranged on the rotating column 99 are not represented, since they are within the knowledge of the skilled artisan.

Figure 11:
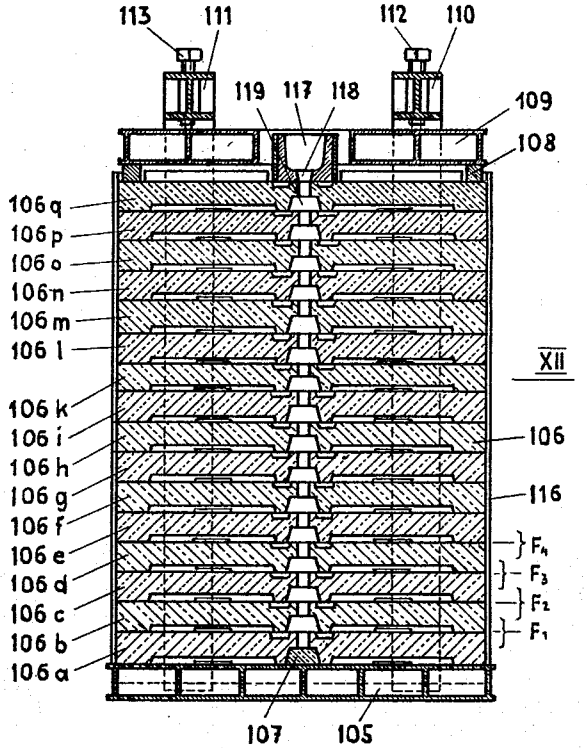
FIG. 11 is a section through a ready-to-cast mold stack taken along the line XI — XI in FIG. 12.

In FIG. 11, there is shown a bed plate 105 having mold sections 106 stacked thereupon with the bottom-most mold section being sealed with a sealing core 107, and a frame 108 bearing on the uppermost mold section 106, on which is attached a cover plate 109 having two clamping screws 112 and 113 arranged in clamping frames 110 and 111. The clamping frames 110 and 111 extend under the bed plate 105 and bear like hooks on the surfaces 114 and 115. An outer piece 116 which surrounds the mold sections 106 also bears on bed plate 105, and is provided at its upper part with slots 128 so that the rise of the liquid metal during the casting can be observed. A sink 117 is so attached on the topmost mold section 106 that its opening 118 is above the common gate 119. The exemplary representation of FIGS. 11 and 12 shows a mold stack which is cast in known manner from the top, but it should be understood such that a mold stack can also be cast rising from the bottom. In such a case, a separate downgate must be provided in the mold stack itself or outside the mold stack through which the liquid metal is poured and fed to a gate such as the common gate 119 which would extend from the bottom. If an outside gate is used for the liquid metal, several mold stacks can be cast in known manner with a common ingate rising from the bottom.

The arrangement shown in FIGS. 1 to 12 for carrying out the method according to the invention operates as follows: A molding unit A is in the open position shown in FIG. 5. An empty frame 16 with clean bores 36 (FIG. 8) is pushed by a cylinder 29 into the position shown in FIG. 4. The cylinders 14 move the upper pattern plate 2 and the lower pattern plate 1 with the connected parts into the position shown in FIGS. 3 and 8. The blow plate 37 with blow head 38 is attached on frame 16 in the direction of the arrow 39. The entire model assembly has already been preheated by the electric heat apparatus to operating temperature, for example, 220°C. Plastic-bonded quartz sand is introduced in a known manner through the bores 36 into the cavity 35. The blow plate 37 with the blow head 38 is then lifted from frame 16 in the direction of the arrow 39 into a position not shown. The electric heating system remains in operation, and the frame 98 with the attached parts is brought by means of the drive 100 over the gearing 101 from position A in the direction of rotation 102 into position B. The piston rod 28 (FIG. 9) whose piston rod head 27 is released by the T-groove guide 26 of frame 16 of molding unit A, engages the corresponding T-groove 26 of frame 16 of molding unit A at the end of the 90° rotation in the direction 102. The cylinders 14 of molding unit D move the lower pattern plates and the upper pattern plates of molding unit D from the closed position shown in FIG. 3 into the open position shown in FIG. 4. The upper pattern plate 2 and the lower pattern plate 1, which are held together by their permanent magnets 9, 42, 43, 46, 47 and the pressing means 51 and 52, are separated from the mold section 85, which remains clamped in the frame 16 held in the guides 18, 19.

Figure 4:
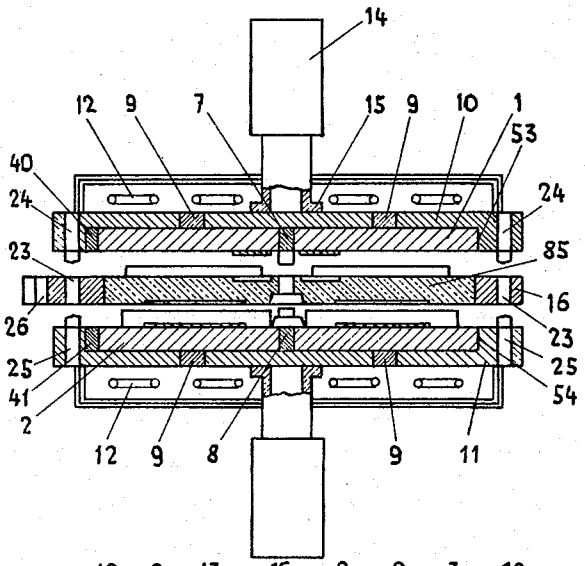
FIG. 4 is a horizontal section showing the molding unit of FIG. 3 in an open position (without pressing means)
Figure 3:
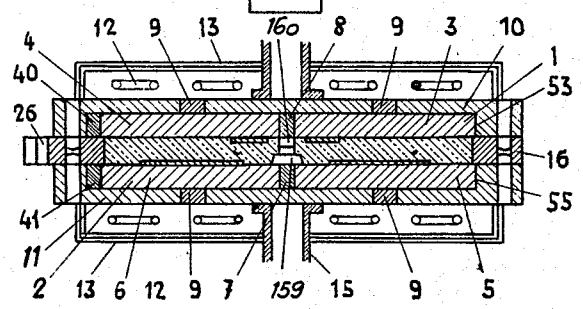
FIG. 3 is a horizontal section through a molding unit shown in a closed position (without pressing means), taken along the line III—III of FIG. 8.
Figure 2:
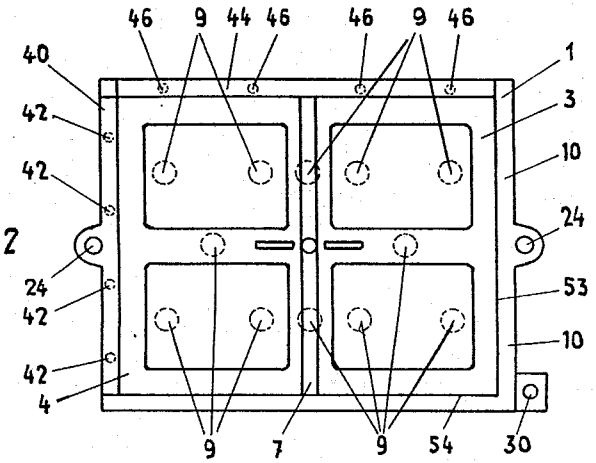
FIG. 2 is a top view of a lower pattern plate taken from the pattern side.
Figure 1:
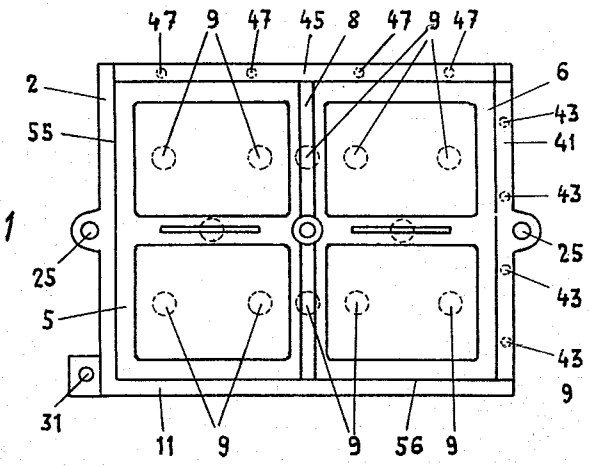
FIG. 1 is a top view of an upper pattern plate taken from the pattern side.

The cylinder 29, whose piston rod head 27 engages the T-groove 26, then pulls frame 16 with the mold part 85 from the position shown in FIG. 4 into the position according to FIGS. 5, 6, 7 and 9. While the fan 80 is in operation, cylinder 73 moves plate 75 in the direction of the arrow 120 and ejects the mold section 85 out of frame 16, which is held by the guides 18, 19, 21 and 22. The ejected mold section 85 is held in a bearing position on the edge 78 of plate 75 by the slight vacuum pressure produced by the fan. The plate 75 pushes the mold section 85 into an end position determined by the path of piston rod 74, which position is so selected that the mold section 85 slightly projects over the front edge 121 (FIG. 10). In this position, the pressing means 86 is actuated to clamp the mold section 85 bearing on the support 81 against the stop face 84 of the U-frame 83. The clamping force is so selected that, when the plate 75 is retracted, the mold section 85 remains clamped in the U-frame 83, secured in its position. When plate 75 reaches the position shown in FIGS. 5, 6, 7, the remaining material is ejected from the bores 36 by a device not shown. The cylinder 29 pushes frame 16 back again into molding unit D in accordance with the arrangement of FIG. 5.

The U-frame 83 with the clamped mold section 85 is turned in a manner not shown about the axle 82; for example, by means of a rotary drive from the vertical position 86 into the horizontal position 88. After the U-frame 83 has reached position 88, the cylinder 122 of table 89 receives pressure and rises in the direction of the arrow 92. This lifting movement in the direction of the arrow 92 is stopped when the mold sections 91 reach the mold section 85 clamped in the U-frame 83 in position 88, thereby interrupting a beam, not shown. Subsequently, the pressing means 86 is retracted, the mold section 85 bears on the mold sections 91, the empty U-frame 83 is moved out of the horizontal position 88 into the vertical position 87, and the table 89 is lowered into a new receiving position according to FIGS. 6 and 10 by reversing the cylinder 122 for a predetermined time.

The molding material which can be used must be flowable, for example, plastic-bonded quartz sand which may be handled utilizing known molding techniques. Clay-bonded sand cannot be used. It is therefore not necessary to provide further information regarding the spraying of the pattern systems, the selection of temperatures, the design of the blow plates or blow heads, etc., since this is within the knowledge of those skilled in the art.

If pattern plates which are covered on one side with patterns are inserted into the molding units A, B, C, D, certain relationships must be considered.

Since the top side of the mold section **106*a* (FIG. 11) together with the underside of the mold section 106*b*, or the top side 106*b* with the underside 106*c* etc. form a mold unit in the stack, the correlated pattern plates must be arranged in the correct order on the individual molding units A, B, C, D. If the lower pattern plate of a mold F1 is arranged, for example, on the side $A^2$ of the molding unit A, (FIG. 5), the latter forms the lower part of the mold F1. To insure that the following mold section formed by molding unit D forms on its underside the upper section of the mold F1, the respective upper pattern plate of mold F1 must be inserted on the side D1 of molding unit D. It follows therefore that the lower pattern plates of the molds F1, F2, F3 and F4 must be inserted on the sides A2, D2, C2, B2 and the respective upper pattern plates on the sides D1, C1, B1 and A1. The number of mold sections 106 of a stack may be advantageously selected so that the total number of mold sections of a stack less one is a multiple of the existing molding units. The mold lost by the first and last mold sections 106*a* and 106*q* is thus evenly distributed over the molds F1, F2, F3 and F4.**

If the arrangement shown in FIGS. 5 and 6 by way of example is used to produce mold sections with pattern plates covered on both sides with patterns, the corresponding considerations yield the following procedure: It is necessary to work simultaneously with eight different pattern systems: that is, mold sections for the molds F1, F2, F3, to F8 are produced. If the lower sections of the mold units are designated with the index u and the upper sections with the index o, it will be seen that mold sections F1, o/F2,u; F3, o/F4,u; F5, o/F6, u and F7, o/F8,u must be produced first and placed in storage. Subsequently the pattern plates are transferred so that the mold sections are produced in the order F8, o/F1,u; F2, o/F3, u; F4,o/F5,u and F6,o/F7,u. During this second cycle, the mold section F1.o/F2,u is attached with the inserted cores from the storage stack, in addition to the corresponding cores which must be inserted into the mold section F8,o/F2,u, and then the mold section F2,o/F3,u is produced with the insertion of the corresponding cores. This is followed by the attachment of the mold sections F3,o/F4,u with the inserted cores from stock. The production of the mold section F6,o/F7,u with the insertion of the core and the attachment of the mold section F7,o/F8,u with the inserted cores from stock concludes the cycle, after which the sequence of operations start again.

If pattern systems of wood, plastic, plaster or other materials are used for the production of the mold sections, and if cold setting molding materials are used, a part of the magnets 9 in the base plates 10, 11 shown in FIG. 1 to 4 is replaced by surfaces which can be sealed and connected over lines to a vacuum pump. The vacuum pressure thus produced holds partial pattern plates of non-magnetic materials in the base plates 10, 11. The magnets 9, provided they are required for retaining the rulers 7 and 8, and the magnets 42, 43, 46, 47 for retaining the rulers 40, 41, 44 and 45 are retained. If gas feeds are required for the setting of the molding material, supply into the cavity 35 is effected preferably over the base plate 10 and the partial pattern plates 3 and 4, or over the base plate 11 and the partial pattern plates 5 and 6.

Figure 15:
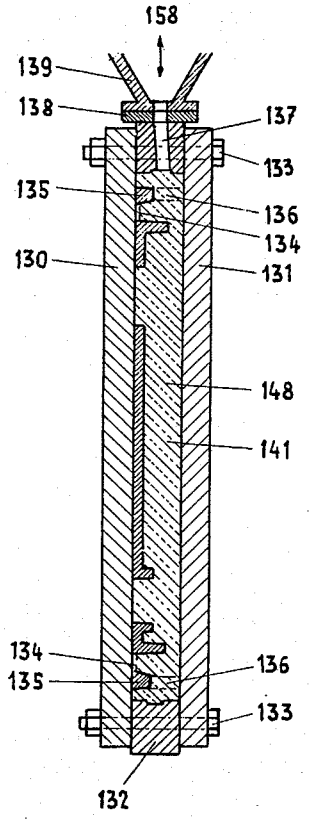
FIG. 15 is a cross sectional view of another embodiment of a molding unit according to the invention.
Figure 17:
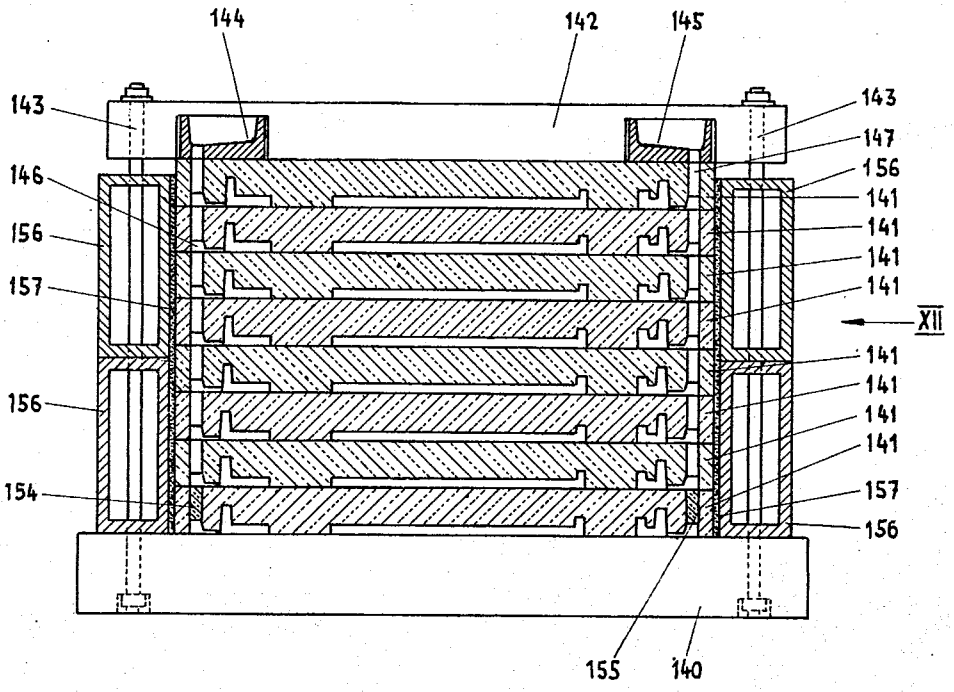
FIG. 17 is a section through the ready-to-cast mold stack of FIG. 16.
Figure 16:
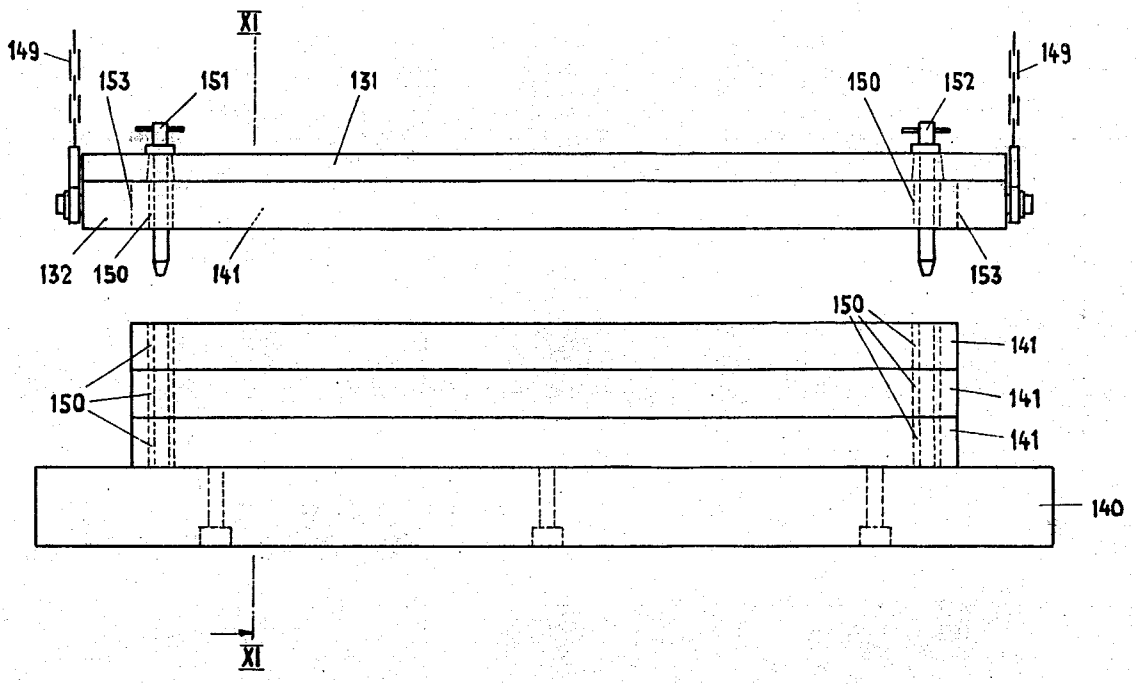
FIG. 16 is a side elevation of a mold stack formed with mold sections produced on the molding unit of FIG. 15.

FIGS. 15, 16 and 17 show an embodiment of the invention wherein furane-resin bonded quartz sand is used. This binder is caused to harden by adding a hardener.

The embodiment according to FIGS. 15, 16 and 17 is used mainly for larger, flat patterns. FIG. 15 shows a lower pattern plate 130 and an upper pattern plate 131 which are spaced by a frame 132 and mutually positioned with dowels located in the pattern plates 130 and 131 and with dowel guides located in the frame 132. The two pattern plates 130 and 131 are clamped together with the interposed frame 132 by fastening elements 133. The pattern parts 134, 135 and 136 which form the casting system are represented on the lower pattern plate 130. The assembly includes blow holes 137 in the frame 132, a blow plate 138 and a blow head 139. FIG. 16 shows a mold stack being formed, and FIG. 17 shows a cross section through a ready-to-cast mold stack, with a bottom plate 140, mold sections 141, and traverses 142. The finished mold stack according to FIG. 17 is clamped together between the bottom plate 140 and the traverses 142 by fastening elements 143. Sinks 144 and 145 are attached on the stacked mold sections 141. Downgates 146 and 147 which are closed in the bottom-most mold section 141 by elements 154 and 155 are indicated in FIG. 17. The longitudinal runners and gates are designed according to conventional casting techniques and are not herein described in detail.

In the method according to the present invention utilizing furane-resin-bonded quartz sand as a molding material, the frame 132 is placed between the lower pattern plate 130 and the upper pattern plate 131 and clamped together therewith by means of fastening elements 133. A vertically positioned blow plate 138 with a blow head 139 is attached in a known manner and, as indicated by arrows 158, the cavity 148 is filled by means of compressed air with furane resin-bonded quartz sand. After a predetermined interval allowing for the setting of the mold section 141, the clamped parts 130, 131, 132 and 133 are turned into a horizontal position, the fastening elements 133 are loosened, and thereafter the top lower pattern plate 130 is lifted. Subsequently, the remaining parts 131, 132 and the mold section 141 are turned in a known manner suspended on chains 149 and brought into the position shown in FIG. 16.

Guide bushes 150, which are molded in a known manner into the mold sections 141, serve as dowel guides allowing for the reception of dowel pins 151 and 152, which permit a stagger-free attachment of the mold section 141 on the mold stack being formed according to FIG. 16 when the parts 131, 132 and 141 are lowered, suspended on the chains 149. After attachment, the dowel pins 151 and 152 are removed, and the upper pattern plates 131 and frame 132, whose inner boundary 153 is provided with a groove 153, are lifted. After all mold sections 141 have been stacked as indicated, the molding boxes 156 are assembled as a frame and lowered onto the bottom plate 140 in the position shown in FIG. 15. After the traverses 142 have been attached, the bottom plate 140 and the mold sections 141 are clamped together with the traverses 142. The cavity 157 between the mold parts 141 and the molding box 156 is filled before the casting operation with pure quartz sand without a binder or other granular material, and the sinks 144 and 145 are attached. When the iron is solidifed in the cast mold stack, the traverses 142 and the fastening elements 143 are removed. After the castings have cooled, the mold stack is brought to the emptying point, the mold boxes 156 are drawn off, and the mold stack is emptied, after which the bottom plate 140 with the guide bushes 150 returns to the molding site and a new cycle starts. Usually, the molds bonded with furan resin are dried and blackened before casting. Since these operations are not essential for the practice of the invention, they are not discussed in detail.

The above described method need not be confined to the use of known materials for the production of pattern plates. However, it is necessary, for example, if utilizing plastic covered quartz sand which is hardened during the molding process in a known manner by heat, to use for the production of pattern plates materials which withstand the temperatures occurring during heating. These pattern assemblies therefore consist mostly of metal.

The use of wood or plastic for the production of patterns or pattern plates is not limited to the use of furan-resin bonded quartz sand. It is also possible to use the CO2-method, the cement method, or other suitable methods. Furthermore, the granular mass of the molding material need not consist of quartz sand. It can also consist of fire-clay sand, zircon sand, or other refractory materials.

The method according to the invention has the advantage that a smaller amount of molding material is required for the production of a given number of castings than in any other known method.

Furthermore, the method according to the present invention has the advantage that the lowest mold sections ensure the optimum application of the stack casting method with regard to the metal yield.

For a major part of the cast workpieces, particularly those of grey cast iron and spheroid cast iron, there is an interdependence between the wall thickness of the workpiece or its use and the analysis of the liquid metal from which it is to be cast. Presently known methods for the production of small castings or of flat, breakable castings require that the ready-to-cast molds be cast continuously or in short intervals, because the molds either dry out or cannot be stored in a space-saving manner. Therefore, they cannot be stored uncast for longer periods of time. It has therefore been indispensable to assign special smaller smelting units to known small casting-molding plants for casting metals of varying analysis.

The method according to the present invention has the advantage that large quantities of ready-to-cast molds can be stacked in a small space. The method has the further advantage that the molds produced according to the invention can be stored uncast for longer periods of time. In practice, both advantages permit elimination of special smelting units for supplying the molding units for the production of small castings with liquid metal, since the casting of the stacked, ready-to-cast molds can be fitted into the general smelting program by production planning. This has the advantage that the smelting program can be better balanced with regard to the liquid iron amount per unit of time.

Figure 20:
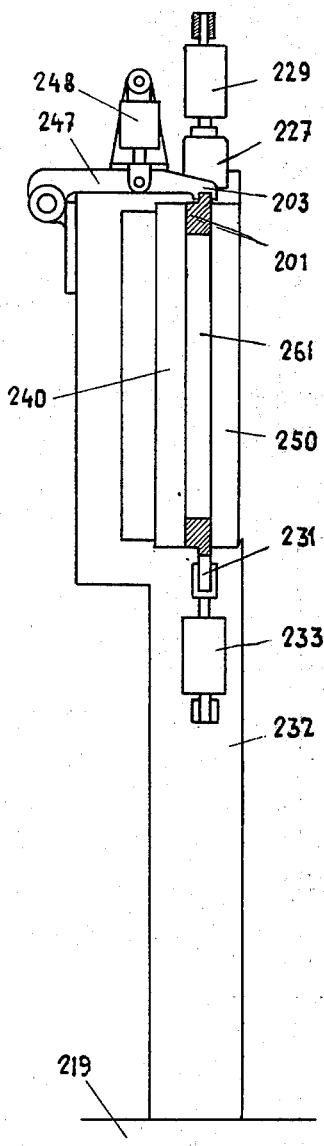
FIG. 20 is a section taken along the line XX—XX in FIG. 18.
Figure 23:
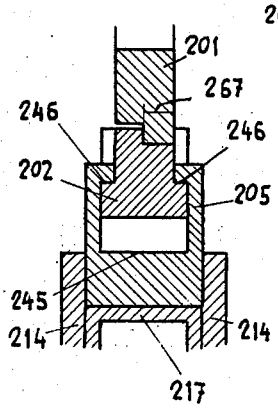
FIG. 23 is a partial section on an enlarged scale taken along the line XXIII—XXIII in FIG. 18.

Another embodiment of the invention is shown in FIGS. 18–23, wherein a frame 201 which can be held by movable guides 202, 203 is shown. The movable guide 202 can be lowered by a lifting device 204, lifted, and held against horizontal displacement. The movable guide 202 is restricted by the guides 205 against rotation and it is also held in the lowered vertical position by the stop faces 245, and in the raised position by the stop faces 246. The movable guide 203 is designed as a lever 247 and can be raised and lowered by cylinders 248 (FIG. 20). The clamp straps 206 and 207 are applied by lifting means 208 and 209 to the clamping surfaces 210 and 211 or they may be lifted into position 212 by reversing the lifting means 208 and 209. The clamp straps 206 and the clamp straps 207 are secured against horizontal rotation by the guides 213, 124 respectively. They are secured against vertical rotation in the raised position 212 by stop faces 249. The guides 213 are secured on a beam 215 which bears on a beam 216 on which the lifting means 208 must also be secured and which forms the supporting construction for a storage tank for molding material not shown. Instead of the clamp straps 206, a clamping frame which can be lowered from the top can be used, and instead of the clamp straps 207 there can be used a clamping frame which can be lifted from the bottom over the model arrangement. The lifting means 204 and the guides 205 bear on a beam 217 which bears on a beam 218 secured on the bottom 219 and which carries at the same time the lifting means 209. The guides 214 are secured on the beam 217.

The clamping lever 220 is rotatably mounted on the beam 215 and can be actuated by a cylinder 221 to apply its clamping surface 222 on the frame 201 or it may be lifted. The clamping lever 223 is rotatably mounted on the beam 224 which bears on the beam 218, and its clamping surface 225 can be applied on the frame 201 by actuating the cylinder 226 or it may be lifted therefrom. The lever 227 is rotatably mounted on a guide 228 and it likewise can be applied by means of a cylinder 229 held on the beam 215 with its clamping surface 230 on the frame 201 or it may be lifted therefrom. The clamping lever 231, which is rotatably mounted on the beam 232, can also be applied by a cylinder 233 bearing on the beam 232 with its clamping surface 234 on the frame 201 or it may be lifted therefrom.

A plate 240 which can receive pattern plates, can be moved by a device 241 toward the frame 201 and be applied thereon, or it can be removed therefrom by device 241. Due to the limitation of the stroke of the device 241, the position 242 of the plate 240 on the side of the frame 201 flush with a tongue 267 is determined perpendicularly to the pattern plane. The positions of the axles 243, 265 and of the guides 244, 246 determine the spatial positions of the plates 240 and 250. The device 241 can be designed as a cylinder including piston and piston rod, or as a motor-driven threaded spindle, the motor being controllable in a known manner into exactly predetermined positions. Preferably, the tongue 267 of the frame 201 is so dimensioned that its smallest dimension does not exceed the thickness of the frame 201 and is flush on one side with the frame 201.

The plate 250 can be moved by a device 251 relative to the frame 201 to either be applied thereto or removed therefrom. The device 251 is secured on a member 252 which is pivoted on a bearing 253. The pivoted member 252 can be clamped in a known manner with a clamping means 254 in the operating position on the member 255, by operating the handle 256. The lugs 257 of the bearings 253 are designed as a part of the member 255. The operating position 258 of the plate 250 can be swung in the direction of the arrow 259, after operation of the clamping means 254, to move the plate 250 to and from the pattern plate changing position 260. In the clamped or operating position, the pivoted member 252 bears on the surface 266 of the member 255.

Figure 21:
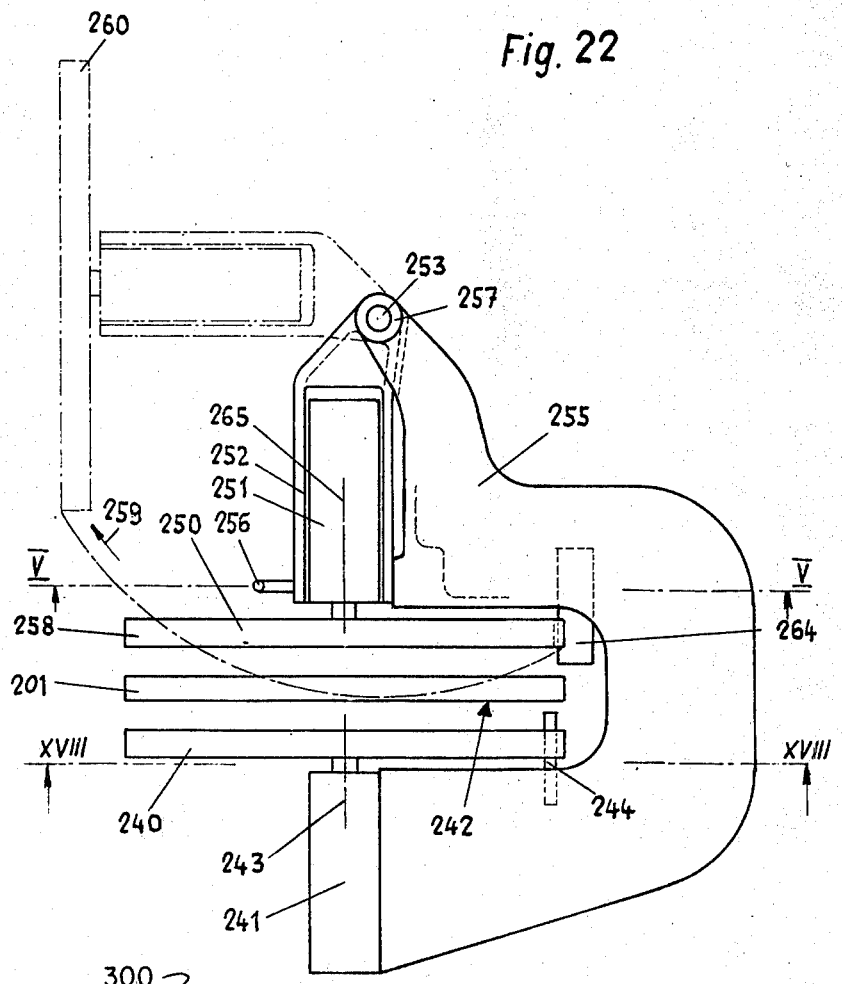
FIG. 21 is a top view of the arrangement according to FIG. 18, without the parts arranged above and under the interposed frame.

In the operation of the embodiments of the invention represented in FIGS. 18 – 23, the empty frame 201 is held in position according to FIG. 21 within the guides 202, 203 (FIGS. 18–20 and 23). The plate 240 is brought into the position according to FIG. 19, which is determined by a stroke limiter of the device 241, by reversing the device 241, and the plate 250 is made to bear on the frame 201 by reversing the device 251. The force which the device 241 must expend in moving in the direction of motion indicated must be selected to be greater than the force which the device 251 can exert. Furthermore, the movement of the plate 240 must be so controlled that it has at least reached the position 242 when the plate 250 bears on the frame 201. The plates 240 and 250 form with their pattern assemblies and with the interposed frame 201 the mold cavity 261 which is filled with the granular material.

Figure 19:
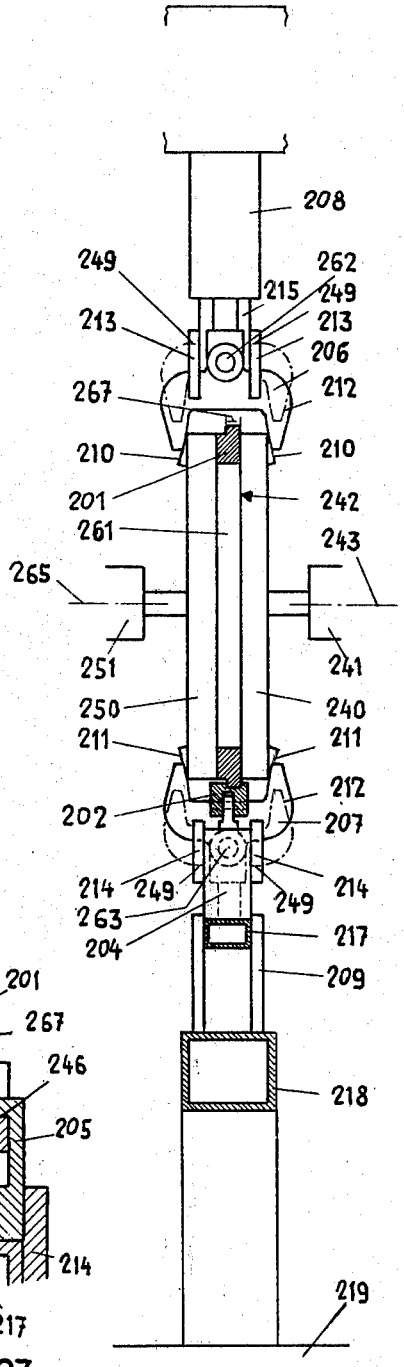
FIG. 19 is a section along the line XIX—XIX in FIG. 18.

By operation of the lifting means 208, 209, the clamp straps 206, 207 are brought into the position 212 according to FIG. 19 so that their clamping surfaces are applied against the clamping surfaces 210 and 211 of the plates 240 and 250. In this operation it is important that the lifting means 208, 209 be connected to a common pressure medium, preferably compressed air, so that a simultaneous and uniform pressure increase of the pressure medium is only possible after all clamping surfaces of the clamp straps 206, 207 are applied. Furthermore, it is necessary that the clamp straps 206 be pivotally mounted on a journal 262 and the clamp straps 207 on a journal 263 so that they can adapt themselves in their positions to the respective clamping surfaces 210 and 211. This has the effect that, from the start to the completion of clamping, neither a force resulting from the clamping nor a resulting torque is exerted on the plates 240 and 250. After the mold cavity 261 has been filled with granular material, the clamp straps 206, 207 are retraced again into position 212, wherein the sluability of the clamp straps 206 is stopped by stop faces 249 of the guide 213, and the sluability of the clamp straps 207 is stopped by stop faces 249 and guide 214.

After the granular material has been introduced into the mold cavity 261 and has hardened, the clamping levers 220, 223, 227, 231 are made to bear with their clamping surfaces 222, 225, 230, 234 on the frame 201 by operation of the cylinders 221, 226, 229, 233, and the frame 201 is thus secured. By corresponding control operations, the device 241 separates the plate 240 and the device 251 separates the plate 250, with the respective pattern plates becoming separated from the frame 201 in which the hardened mold remains. Since the clamping levers 222, 223, 227, 231 retain the frame 201, a tilt-free separation between the mold remaining in the frame and the pattern assemblies arranged in the plates 240 and 250 is ensured. The subsequent operations of extracting the frame 201, ejecting the mold located therein, as well as returning the empty frame 201 into the position shown in FIG. 21 have already been described in connection with the embodiments according to FIG. 1–17 and need not be repeated.

Figure 18:
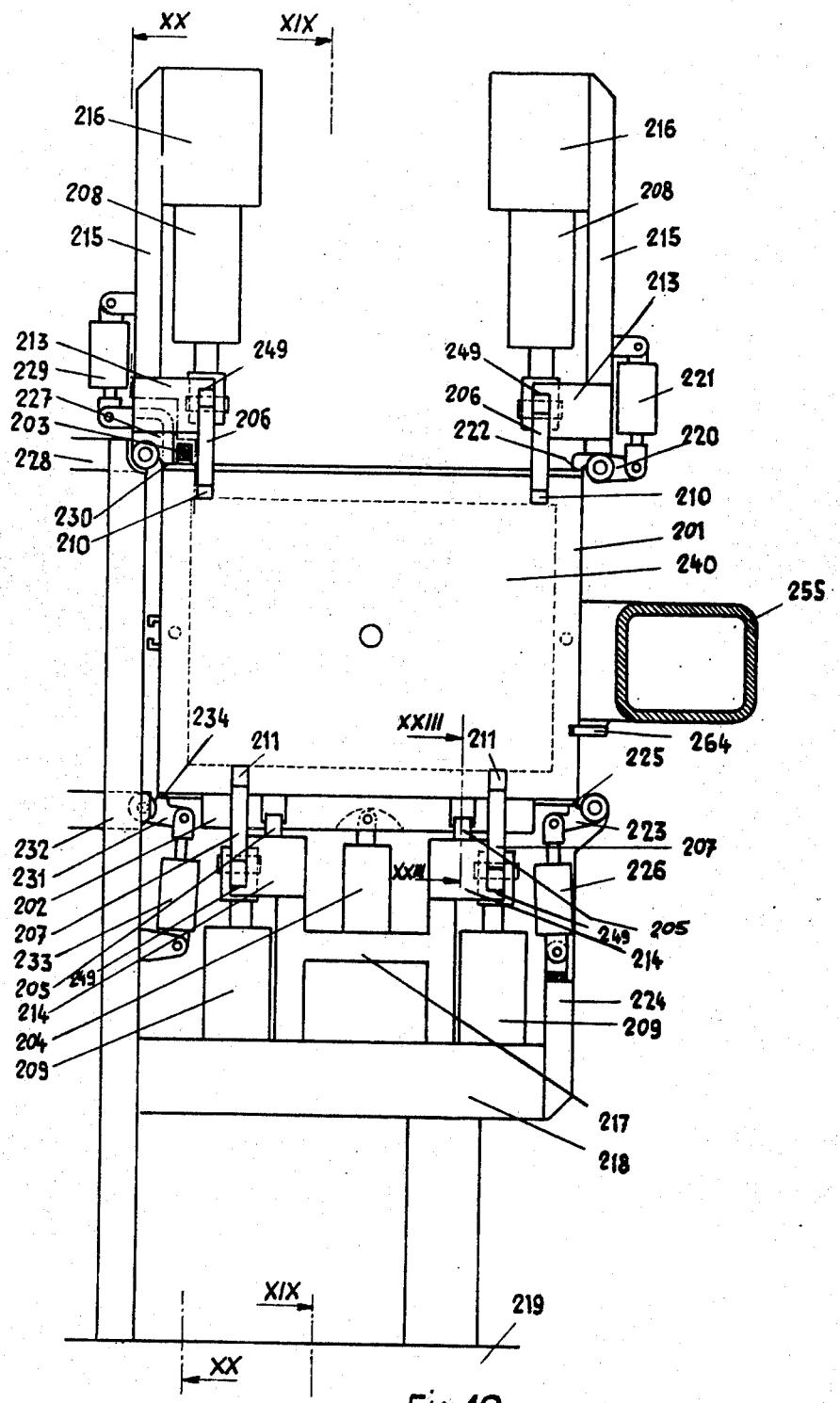
FIG. 18 is a section through another embodiment of the arrangement taken along the line XVIII—XVIII in FIG. 21.
Figure 22:
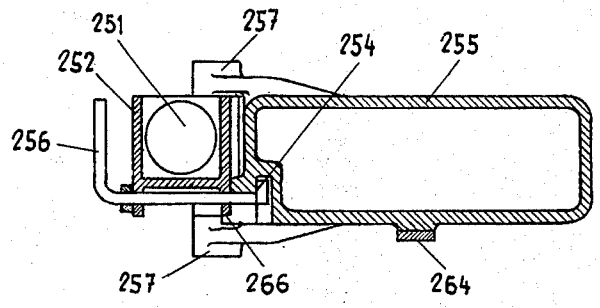
FIG. 22 is a section taken along the line XXII—XXII in FIG. 21.

The member 255 shown in FIGS. 18, 21, 22 bears on the bottom 219 in a manner not shown. This embodiment is used when working with only one pattern assembly. If several pattern assemblies are used at the same time, it is advisable to arrange them according to FIG. 5. Determination of the number of pattern assemblies to be used results, on the one hand, from the time required for extracting the frame 201, ejecting the finished mold, returning the empty frame 201 into the position according to FIG. 10, and filling the mold cavity 261, and on the other hand, from the time required for hardening the granular material in the mold cavity 261. If, for production reasons, the full production capacity is not required, the number of pattern assemblies used simultaneously can be selected to be correspondingly smaller. Although a carousel arrangement has proved to be the most expedient solution when several pattern assemblies are used simultaneously, other possibilities for feeding of the pattern assemblies can also be utilized.

If several pattern assemblies are used, it is necessary to lower the movable guide 202, together with the retraction of the clamp straps 206, 207, into position 212 by operating the lifting means 204, and to lift the movable guide 203 by operating the cylinder 248. After the clamp straps 206, 207 have been lifted and the guides 202, 203 have been retracted from the frame 201, the pattern assemblies, consisting of plate 240, frame 201 and plate 250, are moved through one operating station. Plate 240, frame 201 and plate 250 are held together by the devices 214 and 251. After the pattern assemblies have reached the next position, the guide 202 is lifted by operating the lifting means 203 and the guide 203 is lowered by operating the cylinder 248. While the above-described processes take place in the operating station for the ejection of the finished mold and the filling of the mold cavity 261 with granular material, the other model assemblies remain in position held together by the devices 241 and 251 to ensure hardening of the granular material.

The embodiment according to FIGS. 18 – 23 can be operated both with a manual follow-up control and with a centralized control.

If several pattern assemblies are used at the same time, the retention of the frame 201 with the finished mold during the separation of the pattern assemblies from the frame 201 can be effected in such a way that the clamping levers 220, 223, 227, 231 and the part holding the devices 241 and 251 are held stationary. Alternatively, it is also possible to position the clamping levers 220, 223, 227 and 231 to bear directly on the beams of the devices 241 and 251. The latter embodiment has the disadvantage that each pattern assembly requires a complete set of clamp straps.

The embodiment according to FIGS. 18–23 has the advantage that, when several pattern assemblies are used at the same time, the pattern assemblies are accessible from all sides, apart from the filling and mold removing positions, and they are not, from a practical viewpoint, subject to any limitations regarding the size of the molds.

Figure 24:
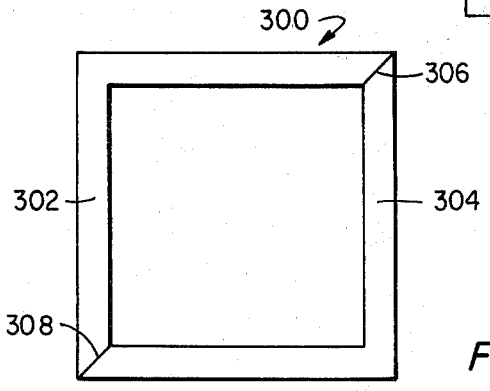
FIG. 24 is a plane view showing a frame which is separable into two parts.

Furthermore, the frame of the invention may be formed so as to be separable into two parts in order thereby to facilitate removal therefrom of the formed mold section. Such a frame 300 is shown in FIG. 24 with the frame being structured from two separable parts 302 and 304 joined along diagonal edges 306 and 308 along which the parts 302, 304 may be separated.

While specific embodiments of the invention have been shown and described in detail to illustrate the application of the inventive principles, it will be understood that the invention may be embodied otherwise without departing from such principles.

I claim:

1. A method for producing foundry mold sections from a mold-forming material having a resin binder comprising the steps of arranging at least two movable pattern plates each having a pattern surface formed thereon in opposed relationship with said pattern surfaces facing each other, disposing between said pattern plates a frame adapted to define together with said pattern plates a mold-forming cavity having a single continuous fixed volume which is peripherally enclosed by said frame when said plates are brought into engagement with said frame therebetween, moving both said pattern plates together into engagement with said frame to form said mold-forming cavity with said pattern plates spaced by said frame a fixed predetermined distance apart, blowing into said mold-forming cavity said mold-forming material having a resin binder through means connected to said frame, holding said pattern plates and said interposed frame in a fixed relationship relative to each other during setting of said mold-forming material within said cavity thereby to form a mold section, said pattern plates and said frame being thus held by means engaging said pattern plates, separating said pattern plates and said frame by moving said pattern plates away from said frame while holding said frame stationary after formation of said mold section by utilization of means engaging said pattern plates and said frame, and thereafter removing said mold section from said frame.

2. A method according to claim 1 wherein after formation of said mold section, said pattern plates are separated from each other and from said frame with said mold section being maintained supported in said frame, said mold section being subsequently removed from said frame and said frame and said mold section being thereafter moved out of the range between said pattern plates.

3. A method according to claim 1 including the further step of arranging said formed mold section after removal thereof from said mold-forming cavity in an assembled relationship with at least one other formed mold section to form therewith a casting mold which may be filled with molten material to form a casting.

4. A method according to claim 1 wherein two associated pattern plates are utilized, said pattern plates being covered on one side thereof with patterns which are arranged opposite each other.

5. A method according to claim 1 wherein the number of mold sections produced is greater than two, said mold sections being produced by utilizing two different pattern plates which are covered on both sides with patterns, with the mold sections thus produced being alternately assembled to form a mold stack defining a mold between each pair of mold sections.

6. A method according to claim 1 wherein at least two mold sections are assembled to form a mold stack, said casting being formed with said mold sections held in a horizontal position, and wherein each of said mold sections are configured to define a molten material inlet for each of the molds of said stack with the inlet of the bottom-most mold of said stack being closed with a plug.

7. A method according to claim 1 wherein at least two mold sections are assembled to form a mold stack, said casting being formed with said mold sections located in a position inclined relative to the horizontal, and wherein each of said mold sections is configured to define a molten material inlet for each of the molds of said stack with the bottom-most mold of said stack being closed with a plug.

8. A method according to claim 1 wherein partial pattern plates having a common casting system are held in a common pattern frame with said partial pattern plates being arranged to act as oppositely located pattern plates.

9. A method according to claim 1 wherein said mold sections are assembled to form a mold stack and wherein a molding box frame is placed around said mold stack and located in a position whereby there is formed an interval between said mold stack and said molding box frame, said interval being filled before casting with a filler material.

10. The method according to claim 9 wherein said filler material is pure quartz sand without a binder.

11. Apparatus for producing foundry mold sections from mold-forming material having a resin binder comprising at least two movable pattern plates, a pattern surface formed on each of said pattern plates, said pattern plates being arranged in opposed relationship with said pattern surfaces of said pattern plates facing each other, a frame located in engagement between said pattern plates to space said pattern plates a fixed predetermined distance from each other, said frame being configured to peripherally enclose the space between said pattern plates to define therebetween a mold-forming cavity having a single continuous fixed volume, means connected to said frame for blowing into said mold-forming cavity said mold-forming material having a resin binder, means engaging said pattern plates for holding said pattern plates and said interposed frame in a fixed relationship relative to each other during setting of said mold-forming material within said cavity thereby to form a mold section, means engaging said pattern plates and said frame for separating said pattern plates and said frame by movement of said pattern plates away from said frame while said frame is held stationary after formation of said mold section to enable removal thereof, said means for separating including means for maintaining said frame stationary during the separation of the pattern plates from said frame and said mold section contained therein and further means for removing from said frame said mold section.

12. Apparatus according to claim 11 including guide elements in said pattern plates, and guide surfaces on said frame arranged to form counter surfaces for said guide elements of said pattern plates with said pattern plates and said frame in assembled condition.

13. Apparatus according to claim 11 wherein said pattern plates include plugs for defining in said molds gates through which molten material for forming a casting may be introduced, said plugs being configured to come into contact with each other when said pattern plates are assembled with said interposed frame.

14. Apparatus according to claim 11 wherein said frame is configured in two separable parts which may be separated after separation therefrom of said pattern plates in order to release a mold section formed therebetween.

15. Apparatus according to claim 11 including means for ejecting a completed mold section from said frame and to transport said completed mold section into a horizontal position.

16. Apparatus according to claim 15 including means for releasing said mold section after it has been transported into said horizontal position, with stop faces being provided onto which said mold section is released by said releasing means.

17. Apparatus according to claim 11 wherein said pattern plates include dowel guides adaptable to have guide bushes attached thereon before formation of a casting, said dowel guides having a length which corresponds to the thickness of said interposed frame.

18. Apparatus according to claim 11 including clamps for clamping said pattern plates together with said interposed frame.

19. Apparatus according to claim 18 including actuating devices for moving said pattern plates together and apart, wherein said clamps are arranged to retain said frame in a position relative to said actuating devices when said pattern plates are separated.

20. Apparatus according to claim 18 wherein said frame includes a tongue, said tongue being configured so as not to exceed the smallest thickness dimension of said frame with said tongue being arranged on one side of said frame flush with the extremities thereof.

21. Apparatus according to claim 19 wherein said actuating devices include means for limiting the stroke thereof on one of the sides of said frame which is flush with said tongue.

22. Apparatus according to claim 18 including means for supporting said pattern plates, pivot means for mounting said supporting means to be pivotable thereabout and support means having mounted therein bearing means forming part of said pivoting means.

* * * * *